US005826552A

United States Patent [19]

Noguchi et al.

[11] Patent Number: 5,826,552

[45] Date of Patent: Oct. 27, 1998

[54] VARIABLE VALVE TIMING DEVICE

[75] Inventors: Yuji Noguchi; Kongo Aoki, both of Toyota; Katsuhiko Eguchi, Kariya, all of Japan

[73] Assignee: Aisin Seiki Kabushiki Kaisha, Aichi-pref., Japan

[21] Appl. No.: 988,668

[22] Filed: Dec. 11, 1997

[30] Foreign Application Priority Data

Dec. 12, 1996 [JP] Japan ..... 8-332527

[51] Int. Cl.[6] ..... F01L 1/344

[52] U.S. Cl. ..... 123/90.17; 123/90.31; 74/568 R; 464/2; 464/160

[58] Field of Search ..... 123/90.15, 90.17, 123/90.31; 74/568 R; 464/1, 2, 160

[56] References Cited

U.S. PATENT DOCUMENTS 4,858,572 8/1989 Shirai et al. ..... 123/90.12
5,666,914 9/1997 Ushida et al. ..... 123/90.17
5,724,929 3/1998 Mikame et al. ..... 123/90.17
5,738,056 4/1998 Mikame et al. ..... 123/90.17

*Primary Examiner*—Weilun Lo
*Attorney, Agent, or Firm*—Hazel & Thomas, P.C.

[57] ABSTRACT

A variable valve timing device includes a rotation shaft and a rotation transmitting member rotatably mounted thereon so as to define a pressure chamber between the shaft and the member. The pressure chamber is divided by a vane extending from the shaft into an advance angle space and a delay angle space. Differentiating pressures in both spaces establishes rotation of the shaft, which enables an adjustment of the phase angle between the shaft and the member. A retracting bore and a receiving bore are formed in the member and the shaft, respectively. A locking valve and a piston are fitted in the retracting bore and the receiving bore, respectively. A fluid passage is formed which extends to a boundary portion between the piston and the locking valve.

7 Claims, 4 Drawing Sheets

VARIABLE VALVE TIMING DEVICE

BACKGROUND OF THE INVENTION

The present invention relates to a variable valve timing device for controlling opening and closing of intake or exhaust valves of an engine. In particular, the present invention is directed to a variable valve timing device of the type which is constructed in such a manner that a pressure chamber is defined between a rotation transmitting member and a rotation shaft opening and closing the intake valves or exhaust valves. The pressure chamber is divided into an advance angle space and a delay angle space by a vane extended into the pressure chamber from the rotation shaft. An angular phase difference between the rotation shaft and the rotation transmitting member is adjusted by differentiating the spaces in pressure so as to vary the timing of the opening and closing of the intake valves or exhaust valves.

One of the conventional variable valve timing devices is disclosed in, for example, the U.S. Pat. No. 4,858,572 granted to Shirai et al. In the foregoing conventional device which is to be referenced with FIGS. 5(A) through 5(C), there is fixedly mounted a rotor 2 on a rotation shaft 1 and a rotation transmitting member 3 is rotatably mounted on the rotor 2. A plurality of vanes 4 are connected to an outer periphery of the rotor 2 and extend into respective pressure chambers 5 defined by an outer periphery, of the rotor 2 and an inner side of the rotation transmitting member 3 such that the pressure chambers are arranged along the outer periphery of the rotor 2. Each vane 4 divides the pressure chamber 5 into an advance angle space 5*a* and a delay angle space 5*b*. The rotation transmitting member 3 is formed therein with a radial retracting bore 6 in which a locking valve 8 and a spring 7 urging the locking valve 8 toward the rotor 2 are accommodated. The rotor 2 is formed therein with a receiving bore 9 in which the locking valve 8 can be received when the receiving bore 9 comes to be in coincidence with the retracting bore 6 in its axis as will be explained later. Oil under pressure is supplied to the advance angle space 5*a* and the delay angle space 5*b* via a passage 10*b* and a passage 10*c*, respectively. In the conventional device, the vane 4 is expected to rotated within the angular extension of the pressure chamber 5 by differentiating the pressures in the advance angle space 5*a* and the delay angle space 5*b*, which results in an adjustment of the rotor 2 or rotation shaft 1 relative to the rotation transmitting member 3 in the phase angle. In the foregoing structure, the passage 10*a* is in fluid communication with the passage 10*b* inside the rotation shaft 1 and is fluidly isolated from the passage 10*c*.

When the rotor 2 is at the most advanced position relative to the rotation transmitting member 3 as shown in FIG. 5(A), as soon as the oil under pressure is supplied to the delay angle space 5*b* via the passage 10*c*, the vane 4 is brought into the counter-clockwise rotation as indicated with an arrow B due to the pressure difference between the advance angle space 5*a* and the delay angle space 5*b*. After such a rotation of the rotor 2 through a set angle, the rotor 2 is brought into its most delayed position relative to the rotation transmitting member 3 as shown in FIG. 5(B). Immediately upon establishment of such a condition, the receiving bore 9 aligns with the retracting bore 6 and due to the urging force of the spring 7, the locking valve 8 is brought into engagement with the receiving bore 9. Thus, the relative rotation between the rotor 2 and the rotation transmitting member 3 is prevented. If the rotor 2 is desired to advance, as shown in FIG. 5(C), the oil is supplied to the advance angle space 5*a* via the passage 10*b* and the oil is discharged from the delay angle space 5*b* via the passage 10*c*. Simultaneously, the oil is supplied to the passage 10*a* and the locking valve 8 is ejected from the receiving bore 9 into the retracting bore 6. Thus, the vane 4 is permitted to rotate in the clockwise direction as indicated with an arrow A in FIG. 5(C).

In the foregoing structure, whenever the rotor 2 takes the most delayed position relative to the rotation transmitting member 3, the locking valve 8 is brought into engagement with the receiving bore 9 and whenever advancement of the rotor 2 relative to the rotation transmitting member 3 is desired, the locking valve 8 is retracted to the retracting bore 9, differentiating the spaces 5*a* and 5*b* in pressure is established. As mentioned above, the passage 10*a* meets with the passage 10*b* inside the rotating shaft 1. Such a connection is intended for accomplishing two purposes: one is to isolate the passage 10*b* when the rotor 2 is desired to be transferred toward the delayed position in order to establish smooth receipt of the locking valve 8 into the receiving bore 9 subsequent to the discharge of the oil therefrom immediately when the most delayed position is taken. The other is to establish a quick ejection of the locking valve 8 from the receiving bore and a quick subsequent transfer of the rotor 2 toward the most advanced position by establishing simultaneous oil supply into the receiving bore 9 and the advance angle space 5*a*.

However, frequent engagements of the locking valve 8 with the receiving bore 8 each of which occurs whenever the rotor 2 takes the most delayed position relative to the rotation transmitting member 3 is established, lead to each of the locking valve 8, the receiving bore 9 and the retracting bore 8 have to be of high durability. Thus, manufacturing these members as payable ones are in effect difficult.

In addition, the principal purpose for regulating the phase angle between the rotor 2 (or the rotation shaft 1) and the rotation transmitting member 3 by employing the locking valve 8 is as follows: After the pressure in each of the spaces 5*a* and 5*b* drops when the cessation of an oil driving device occurs due to the stoppage of the engine, for example, even if the engine is re-started, simultaneous rises in pressure in each of spaces 5*a* and 5*b* cannot be established, which allows the vane 4 to rotate freely in the pressure chamber. The resultant vane 4 is brought into engagement with a side wall of the pressure chamber 5 and a collision noise is generated. To avoid such noise generation, the movement of the vane 4 is expected to be restricted in such a manner that the locking valve 8 prevents the relative rotation between the rotor 2 and the rotation transmitting member 3 until the pressure in each of the spaces 5*a* and 5*b* is raised to a sufficient value. It is to be noted that to the contrary while the engine is ruing, sufficient pressure is built up in either the advance angle space 5*a* or the delay angle space 5*b* thereby preventing the free rotation of the vane 4. As a result, the foregoing noise generation fails to occur.

In brief, though the locking valve 8 is an essential element for the variable valve timing device, its durability cannot be assured due to frequent engagement and disengagement with the receiving bore 9.

SUMMARY OF THE INVENTION

It is, therefore, a principal object of the present invention to provide a variable valve timing device which is free from the foregoing drawback.

It is another object of the present invention to provide a variable valve timing device in which the frequency of the locking valve moving into and away from the receiving bore is relatively lessened in comparison with the conventional device.

In order to attain the above objects, a variable valve timing device according to the present invention includes:

a rotation shaft for opening and closing a valve;

a rotation transmitting member rotatably mounted on the rotation shaft;

a vane connected to one of the rotation shaft and the rotation transmitting member;

the rotational shaft and the rotational transmitting member defining therebetween a pressure chamber which is divided into an advance angle space and a delay angle space by the vane being extended into the pressure chamber;

a first passage being in fluid communication with the advance angle space for supplying and discharging a fluid therein and therefrom, respectively;

a second passage being in fluid communication with the delay angle space for supplying and discharging the fluid therein and therefrom, respectively;

one of the rotation shaft and the rotation transmitting member being formed therein with a retracting bore;

the other of the rotation shaft and the rotation transmitting member being formed therein with a receiving bore;

locking valve fitted in the retracting bore;

a spring accommodated in the retracting bore and continually urging the locking valve outside the retracting bore;

the other of the rotation shaft and the rotation transmitting member being formed therein with a third fluid passage and a receiving bore, the receiving bore having a bottom connected with the third fluid passage and being expected to receive the locking valve when the receiving bore is brought into alignment with the retracting bore;

a piston fitted in the receiving bore; and fourth fluid passage means extending to a boundary portion between the piston and the locking valve when the receiving bore is in alignment with the retracting bore.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DETAILED DESCRIPTION OF THE INVENTION

A preferred embodiment of the present invention will be described hereinafter in detail with reference to the accompanying drawings.

Figure 1:
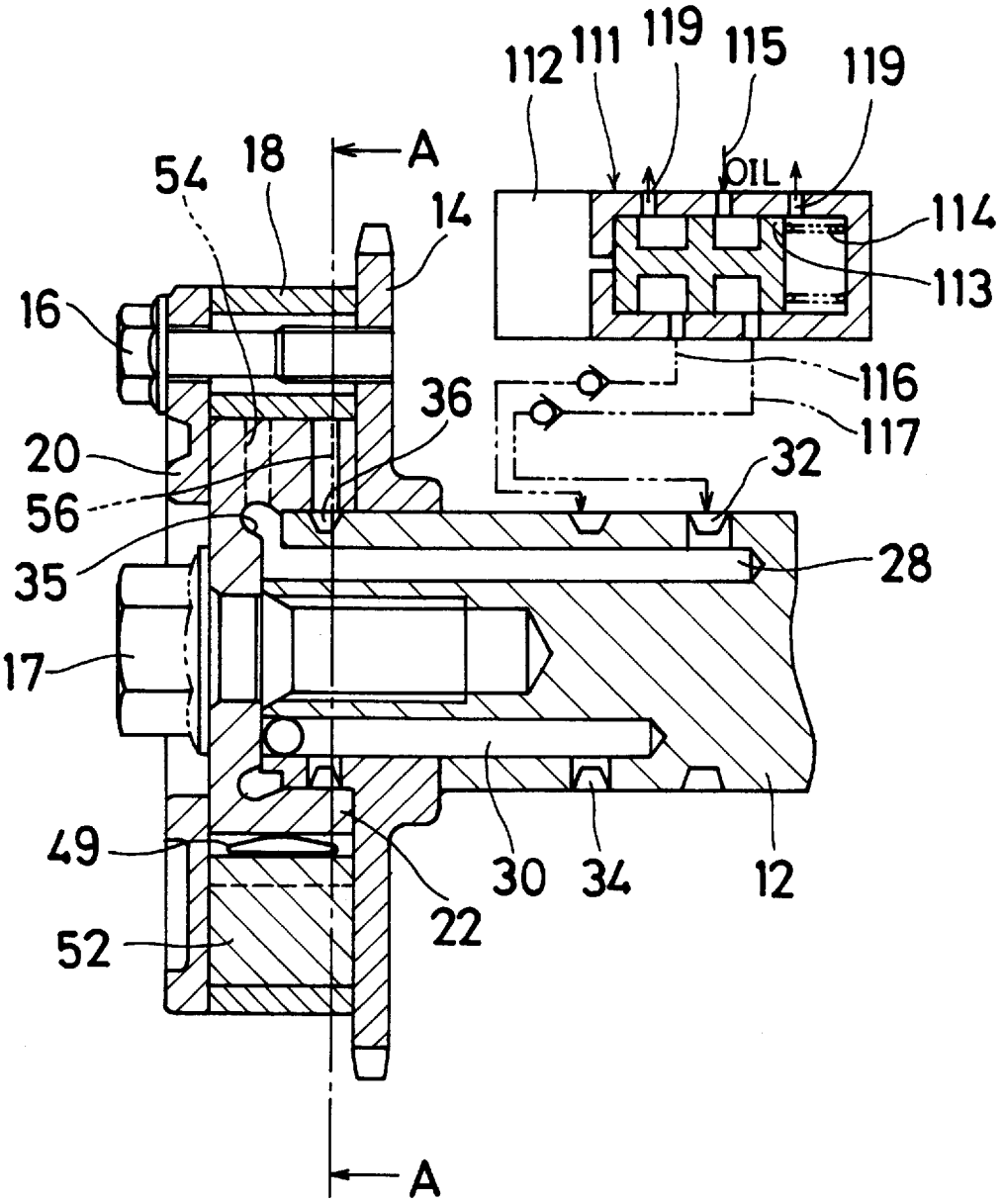
FIG. 1 is a cross-sectional view of a variable valve timing device according to an embodiment of the present invention.

Referring first to FIG. 1, a cam shaft 12, which will be referred hereinafter as a rotation shaft, is mounted thereon with a cam (not shown) which opens and closes an intake valve (not shown) provided to a cylinder head (not shown). A variable valve timing device, as will become apparent from the following description, is provided at one end portion of the cam shaft 12. In the variable valve timing device which is in the form of the disclosed configuration, a rotation is transmitted from a crank shaft (not shown) via a belt or chain to a timing pulley 14 mounted on the cam shaft 12. The timing pulley 14, an external rotor 18 and an outer plate 20 are fastened by a common bolt 16 so as to prevent a rotation of any one of the members 14, 18 and 20 relative to the other members.

Inside the outer rotor 18 which is formed into a cylindrical configuration, an inner rotor 22 is fixedly mounted on one end portion of the cam shaft 12 by means of a bolt 17. Thus, a relative movement or rotation between the cam shaft 12 and the outer rotor 18 which acts as a principal element of a rotation transmitting device is expected to be established between an outer circumference periphery of the inner rotor 22 and an inner circumference periphery of the outer rotor 18.

In the cam shaft 12, there are formed a delay angle passage 28 and an advance angle passage 30 which are extended in the axial direction. One end of the delay angle passage 28 and one end of the advance angle passage 30 are in fluid communication with outer peripheral ports 35 and 36, respectively. The other end of the delay angle passage 28 and the other end of the advance angle passage 30 are in fluid communication with outer peripheral ports 32 and 34, respectively. Oil is expected to be supplied from an oil pump (not shown) to either the port 32 or the port 34 exclusively via a switching valve 111. Instead of the oil, other liquid or gas such as air is available.

The switching valve 111 is constructed in such a manner that when a solenoid 112 is energized, a spool 113 is moved against an urging force of a spring 114 in the rightward direction. While the spool 114 remains the illustrated condition, the switching valve 111 establishes a fluid communication between a passage 117 and the port 32 as well as establishes a fluid communication between a passage 116 and the port 34. The passage 115 is in fluid communication with a passage 117 to which the oil is supplied from the oil pump. The passage 116 is in fluid communication with a drain 119. Thus, the port 32 and the port 34 are in an oil supply condition and an oil drain condition, respectively, which results in that the oil is being supplied to the advance angle passage 28 while the solenoid 112 is being energized.

To the contrary, when the spool 13 is brought into its most right position due to energizing the solenoid 112, the port 32 and the port 34 are in an oil drain condition and an oil supply condition, respectively, which results in that the oil is being supplied to the delay angle passage 30 while the solenoid 113 is not being energized.

Figure 2:
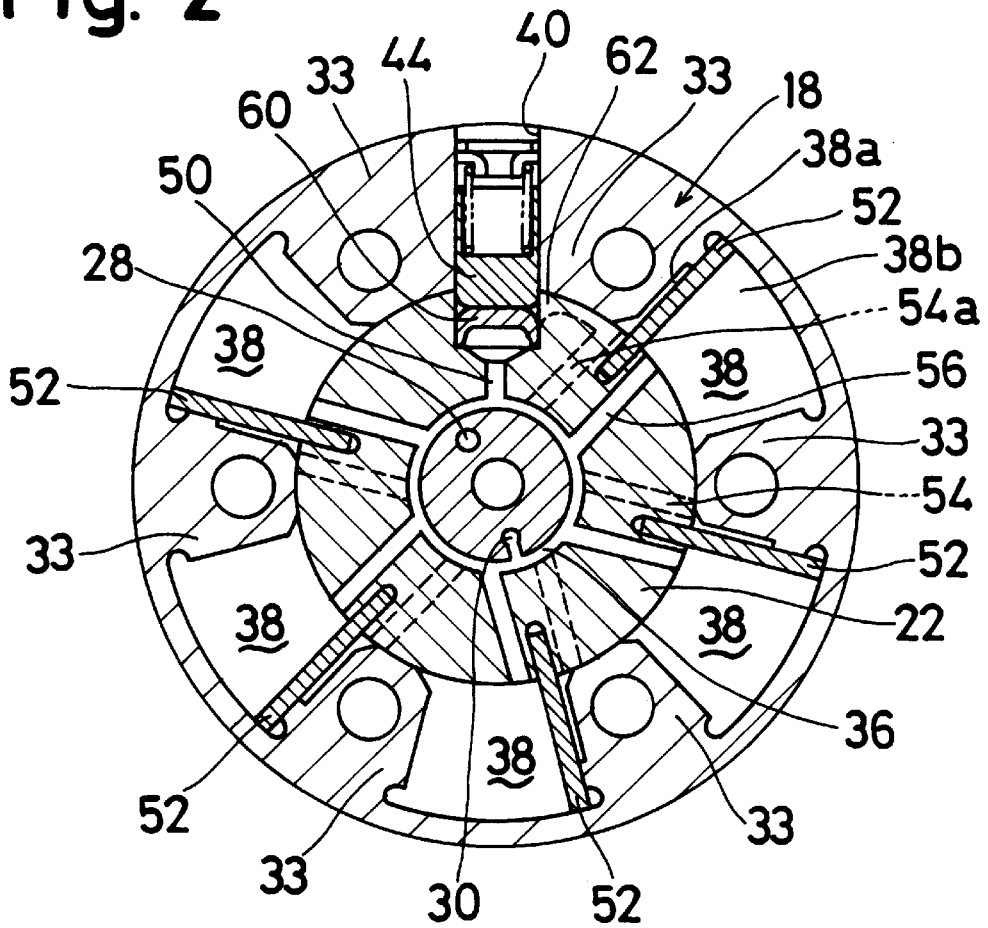
FIG. 2 is a cross-sectional view taken along line A—A in FIG. 1.

As best shown in FIG. 2, at the inner circumference surface of the outer rotor 18, there are formed five pressure chambers 38, each of which is defined by two adjacent partition walls 33, and a sole retracting bore 40. Each pressure chamber 38 is divided into an advance angle space 38*a* and a delay angle space 38*b* by a vane 52. The vane 52 is connected to the inner rotor 22 such that the vane extends outwardly along the radial direction of the inner rotor 22, and is received in the pressure chamber 38. The vane 52 is urged outwardly by a sparing 49 which is positioned at an end portion of the inner rotor 22 (FIG. 1) so as to be in sliding engagement with a bottom of the pressure chamber 38. The advance space 38*a* is in fluid communication with a port 35 of the advance angle passage 28 through an intermediate passage 54 formed in the inner rotor 22.

Figure 3:
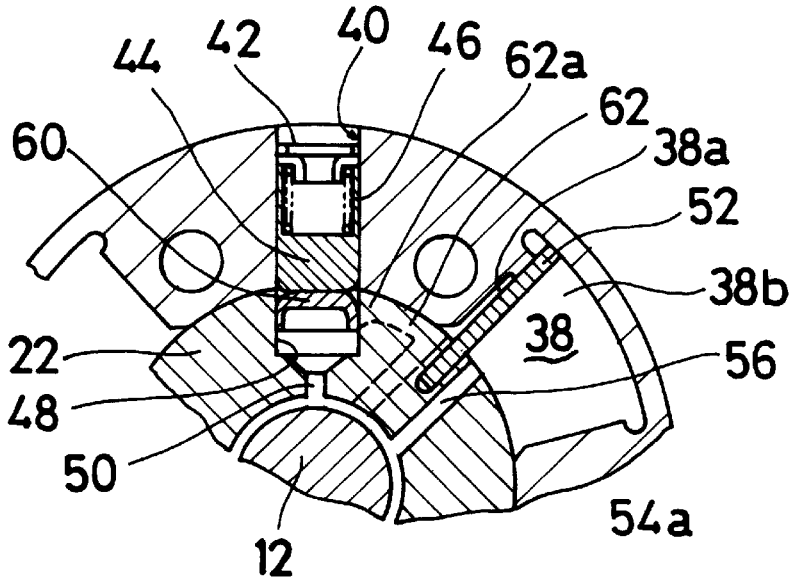
FIG. 3 is an enlarged view of a principal portion of the variable valve timing device shown in FIG. 1.

As shown in FIG. 3, the retracting bore 40 formed in the outer rotor 18 is covered with or sealed by a plug 42 having at outer portion thereof an air breeder (not shown). The plug 42 is provided therein with a spring 46 which constitutes an external urging means. The spring 46 urges a locking member valve 44 toward the inner rotor 22 which is slidably fitted in the retracting bore 40. In the outer peripheral surface of the inner rotor 22 which is slidably fitted on the retracting bore 40. In the outer peripheral surface of the inner rotor 22, there is formed a receiving bore 48 whose diameter is equal to that of the retracting bore 40. At a central portion of a bottom of the receiving bore 48, a passage 50 is formed which extends into a central portion of the inner rotor 22 so as to be in fluid communication with the outer peripheral port 36. Thus, the passage 50 comes to be in fluid communication with the delay angle passage 30 and the intermediate passage 56 via the outer peripheral port 36. In addition, in the receiving bore 48, a piston 60 is so slidably fitted as to oppose to the locking valve 44. The piston 60 is expected to eject or exclude the locking valve 44 outside the receiving bore 48 against the urging force of the spring 46 when the piston 44 is urged with the oil under pressure supplied to the receiving bore 48 via the delay angle passage and the passage 50.

In the instant embodiment, the most delayed phase condition is expected to be established between a phase angle of the cam shaft 12 and a phase angle of the outer rotor 18 when the receiving bore 48 and the retracting bore 40 are in phase. In other words, as shown in FIG. 3, when the vane 52 minimizes the volume of the advance angle space 38*a* to which a pressure is supplied during phase advance, the receiving bore 48 and the retracting bore 40 becomes in phase.

In addition, in the instant embodiment, of the five intermediate passages for discharging the oil under pressure in the respective advance angle space 38*a*, only the intermediate passage 54*a* neighboring the receiving bore 48 is in fluid communication with both of the corresponding advance angle space 38*a* and a passage 62 which is branched from the passage 54*a* to communicate with an outer portion of the receiving bore 48. In particular, an opening of an end 62*a* of the passage 62 opposed to the receiving bore 48 is expanded or enlarged for enabling oil supply concurrently to a contact portion between a top end of the locking valve 40 and a top end the piston 60. Such oil supply becomes effective by rounding both of top ends of the locking valve 40 and the piston 60.

The variable valve timing device thus constructed operates as follows.

Figure 4A:
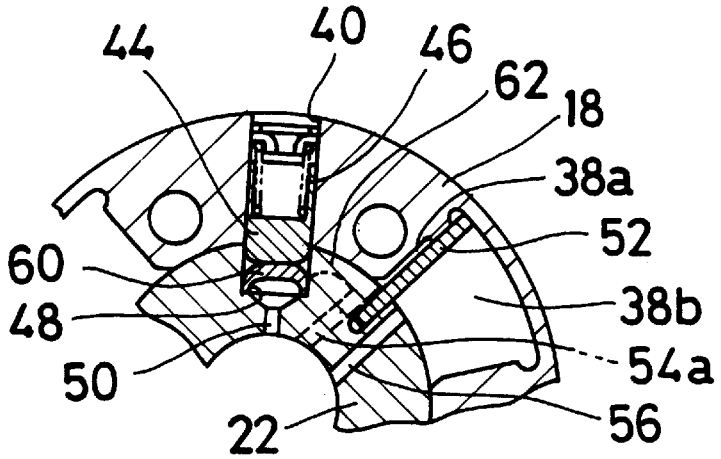
FIG. 4(A) is a cross-sectional view of the variable valve timing device when a rotation shaft is at its most delayed position relative the rotation transmitting member when the oil pump is at rest.

While an engine (not shown) is being at rest, the oil pump also remains non-operational, which results in that the pressure of the oil drops which is in the delay angle passage 28, the advance angle passage 30, the advance angle spaces 38*a*, the delay angle spaces 38*b*, the passage 50, the immediate passage 54, and immediate passage 56. Thus, the locking valve 44 is urged by the spring 46 and is moved into the receiving bore 48, as shown in FIG. 4(A). Such an insertion of the locking valve 44 into the receiving bore 48 regulates or prevents a relative rotation between the inner rotor 22 and the outer rotor 18. Even though the insertion of the locking valve 46 into the receiving bore 48 is unsuccessful due to an out of phase between the receiving bore 40 and the retracting bore 40 when the engine is at rest, the desired insertion can be established. The reason is that the vane 52 begins to rotate toward the delayed phase angle side immediately when the engine starts, such a rotation completes while the oil pressure in each the spaces 38*a* and 38*b* is at a low level, and as soon as the vane 52 takes the most delayed position, the receiving bore 48 and the retracting bore 40 become in phase.

Figure 4B:
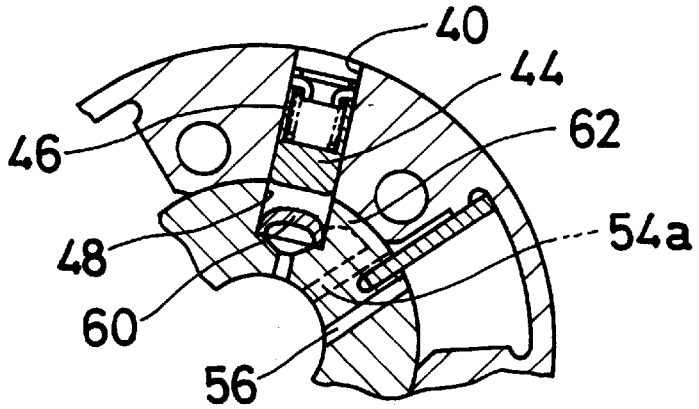
FIG. 4(B) is a cross-sectional view of the variable valve timing device when the rotation shaft begins to take an advanced position.
Figure 4C:
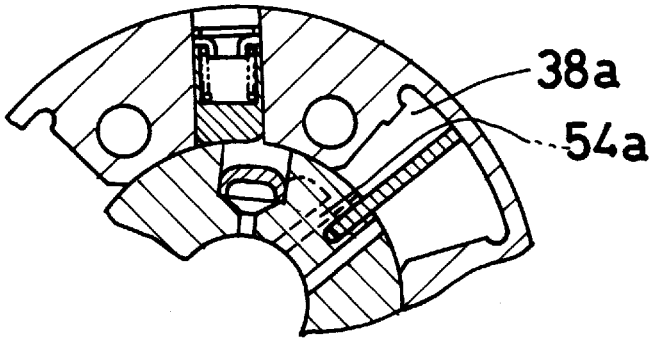
FIG. 4(C) is a cross-sectional view of the variable valve timing device when the rotation shaft is at an initial stage of a movement toward the advanced position.

If an advance of the phase angle is desired while the rotor 22 is at its most delayed position as shown in FIG. 4(A), the solenoid 112 of the switching valve 111 is energized and the oil is supplied into the advance angle passage 28 and is introduced via the intermediate passage 54 to the advance angle space 38*a*. At this time, due to the insertion of the locking valve 44 into the receiving bore 48, the relative rotation is prevented between the inner rotor 22 and the outer rotor 18. However, as shown in FIG. 4(B), some oil enters between the piston 60 and the locking valve 44 via the passage 62 from the immediate passage 54*a* which neighbors receiving bore 48, and the pressure of the resultant oil ejects the locking valve 44 outside the receiving bore 48 by overcoming the urging force of the spring 46. Thus, the relative rotation of the inner rotor 22 and the outer rotor 18 becomes possible, and the rotor 22 begins to the advance or clockwise movement relative to the outer rotor 18 as shown in FIG. 4(C).

Figure 4D:
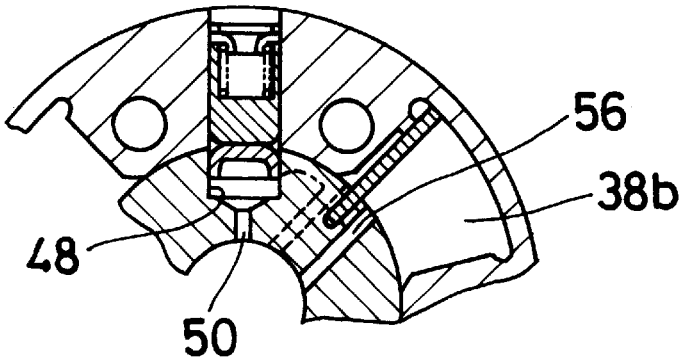
FIG. 4(D) is a cross-sectional view of the variable valve timing device when the rotation shaft is at its most delayed position under that the oil pump is being driven.
Figure 5A:
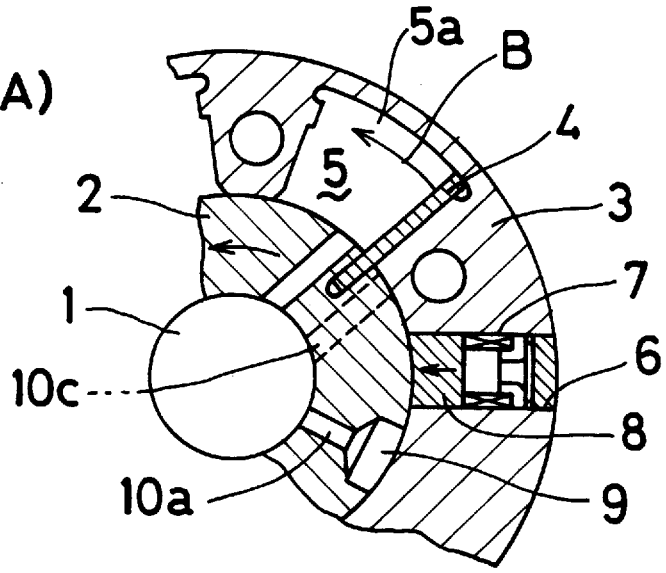
Fig. 5(A) Prior Art
FIG. 5(A) is a cross-sectional view of a conventional variable valve timing device when a rotor is at its most advanced position relative to a rotation transmitting member.
Figure 5B:
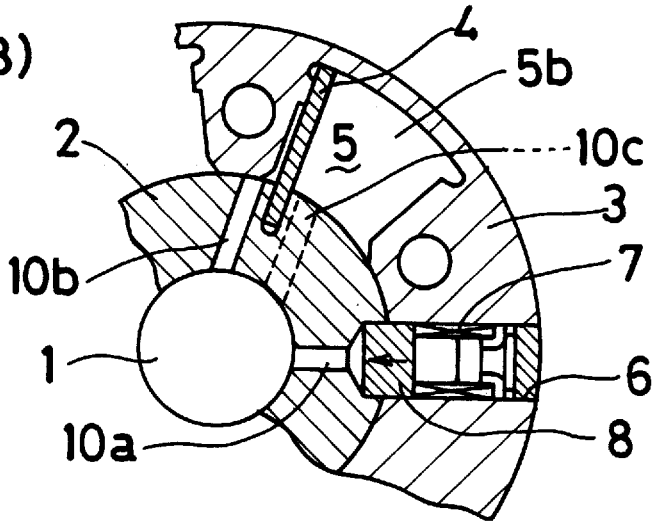
Fig. 5(B) Prior Art
FIG. 5(B) is a cross-sectional view of the conventional variable valve timing device when the rotor is at its most delayed position relative to the rotation transmitting member.
Figure 5C:
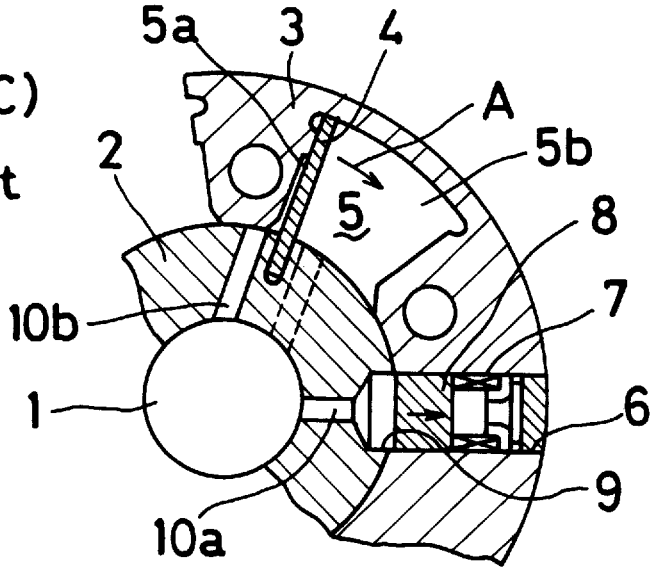
Fig. 5(C) Prior Art
FIG. 5(C) is a cross-sectional view of the conventional variable valve timing device when the rotor is in the course of an advance movement.

On the other hand, when the relative rotation between the outer rotor 18 and the inner rotor 22 is desired to be in a delayed condition, the oil under pressure is supplied to the delay angle space 38*b* through the delay angle passage 30 and the intermediate passage 50 by de-energizing the switching valve 111. In addition to the resultant condition, the intermediate passage 56 and the intermediate passage 50 are in fluid communication with each other, the oil under pressure is also being filled in the receiving bore 48. Thus, even though the relative position between the inner rotor 22 and the outer rotor 18 becomes the most delayed condition as shown in FIG. 4(D), the filled oil in the receiving bore 48 which is under pressure moves the piston 60 outside the receiving bore 48, which enables a prevention of the entrance of the locking valve 44.

As mentioned above, in the present embodiment, forming the intermediate passage 62 by branching from the passage 54*a* in the neighborhood of the receiving bore 48 can prevent the entrance of the locking valve 44 into the receiving bore 48 in both when the oil is supplied to the intermediate passage 54*a* and when the oil is supplied to the passage 56. Thus, while the engine is in rotation which drives the oil pump continually, the locking valve 44 is kept at its rest condition or immovable condition, which results in an increase in the life or durability of the locking valve 44 as well as prevents unnecessary movement thereof.

In accordance with the present invention defined by claim 1, when the retracting bore and the receiving bore are in alignment condition and are supplied with the oil under pressure, the resultant oil constitutes an oil accumulation between the locking valve and the piston, by which the locking valve fails to enter the receiving bore. Thus, relative rotation between the rotation shaft and the rotation transmitting member may not be prevented.

In accordance with the present invention defined by claim 2, even though the rotation shaft is brought into movement toward the most delayed angle position under a condition that insufficient oil remain in each space for example upon initiation of the engine, the locking valve is fitted into the receiving bore, resulting in that a relative rotation between the rotation shaft and the rotation transmitting member is prevented. Thus, noise generation upon collision of the vane to the side wall of the pressure chamber fails to occur.

In accordance with the present invention defined by claims 3 or 4, upon movement of the rotation shaft to its most advanced position, the oil to be supplied to the first fluid passage is also supplied via the fourth fluid passage means to a boundary portion between the piston and the locking valve. The resulting oil acts as a force for urging the locking valve toward the retracting bore and thus the locking piston is prevented from being fit fitted into the receiving bore. On the other hand, upon movement of the rotation shaft toward its most delayed position, the oil to be supplied to the delay angle space is also supplied via the third fluid passage to the bottom of the receiving bore, resulting in that the piston is urged to the locking valve and thus the locking valve cannot enter the receiving bore. At least one of the first fluid passage and the second fluid passage is supplied with the oil, which prevents the locking valve from being fitted into the receiving bore and the relative rotation between the rotation shaft and the rotation transmitting member can be regulated or inhibited.

In accordance with the present invention defined by claims 6 or 7, the fourth fluid passage means can be established, without difficulties, only by forming a groove in one of surfaces of the rotation shaft and the rotation transmitting member.

The invention has thus been shown and described with reference to a specific embodiment; however, it should be noted that the invention is in no way limited to the details of the illustrated structures but changes and modifications may be made without departing from the scope of the appended claims.

What is claimed is:

1. A variable valve timing device comprising:

a rotation shaft for opening and closing a valve;

a rotation transmitting member rotatably mounted on the rotation shaft;

a vane connected to one of the rotation shaft and the rotation transmitting member, the rotational shaft and the rotational transmitting member defining therebetween a pressure chamber which is divided into an advance angle space and a delay angle space by the vane being extended into the pressure chamber;

a first passage being in fluid communication with the advance angle space for supplying and discharging a fluid therein and therefrom, respectively;

a second passage being in fluid communication with the delay angle space for supplying and discharging the fluid therein and therefrom, respectively, one of the rotation shaft and the rotation transmitting member being formed therein with a retracting bore, and the other of the rotation shaft and the rotation transmitting member being formed therein with a receiving bore;

locking valve fitted in the retracting bore;

a spring accommodated in the retracting bore and continually urging the locking valve outside the retracting bore, the other of the rotation shaft and the rotation transmitting member being formed therein with a third fluid passage, the receiving bore having a bottom connected with the third fluid passage and being formed to receive the locking valve when the receiving bore is brought into alignment with the retracting bore;

a piston fitted in the receiving bore and a fourth fluid passage means extending to a boundary portion between the piston and the locking valve when the receiving bore is in alignment with the retracting bore.

2. A variable valve timing device as set forth in claim 1, wherein the alignment between the rotation shaft and the rotation transmitting member is established when the rotation shaft is at its most delayed angular position relative to the rotation transmission member.

3. A variable valve timing device as set forth in claim 1, wherein the first fluid passage is in fluid communication with the fourth fluid passage means and the second passage is in fluid communication with the third fluid passage.

4. A variable valve timing device as set forth in claim 1, wherein the alignment between the rotation shaft and the rotation transmitting member is established when the rotation shaft is at its most delayed angular position relative to the rotation transmission member, the first fluid passage is in fluid communication with the fourth fluid passage means and the second passage is in fluid communication with the third fluid passage.

5. A variable valve timing device as set forth in claim 1, wherein the fourth fluid passage means is formed at a sliding boundary between the rotation shaft and the rotation transmitting member.

6. A variable valve timing device as set forth in claim 2, wherein the fourth fluid passage means is formed at a sliding boundary between the rotation shaft and the rotation transmitting member.

7. A variable valve timing device as set forth in claim 3, wherein the fourth fluid passage means is formed at a sliding boundary between the rotation shaft and the rotation transmitting member.

* * * * *